United States Patent [19]

Hatanaka et al.

[11] 4,225,767

[45] Sep. 30, 1980

[54] MICROWAVE OVEN HAVING UNEVEN BOTTOM WALL OVEN CAVITY

[75] Inventors: Takayoshi Hatanaka, Osaka; Tsuguharu Yakushiji, Sakai; Kanji Tanaka, Yao, all of Japan

[73] Assignee: Sharp Kabushiki Kaisha, Osaka, Japan

[21] Appl. No.: 957,159

[22] Filed: Nov. 2, 1978

[30] Foreign Application Priority Data

Nov. 4, 1977 [JP] Japan ..... 52/132957

[51] Int. Cl.[2] ..... H05B 9/06

[52] U.S. Cl. ..... 219/10.55 F; 219/10.55 R

[58] Field of Search ..... 219/10.55 F, 10.55 R, 219/10.55 M, 10.55 B

[56] References Cited

U.S. PATENT DOCUMENTS

| | | | |
|---|---|---|---|
| 3,388,231 | 6/1968 | Staats | 219/10.55 F |
| 4,036,151 | 7/1977 | Shin | 219/10.55 R |

*Primary Examiner*—Arthur T. Grimley

*Attorney, Agent, or Firm*—Birch, Stewart, Kolasch & Birch

[57] ABSTRACT

A microwave oven comprises a source of microwave energy for heating a food, a table for carrying the food, and an oven cavity with an uneven bottom wall for providing random reflection of the microwave energy wherein a distance between the uneven bottom wall of the oven cavity and the table is variable because of the uneven bottom to unify the intensity of the microwave energy throughout the oven cavity, whereby the food positioned on the table is exposed to uniform intensity of the microwave energy.

12 Claims, 4 Drawing Figures

MICROWAVE OVEN HAVING UNEVEN BOTTOM WALL OVEN CAVITY

BACKGROUND OF THE INVENTION

1. Field of the Invention

The present invention relates to a configuration of a microwave oven and, more particularly, to a configuration of an oven cavity of a microwave oven including an uneven bottom wall for purposes of assuring uniform heating.

2. Description of the Prior Art

Well known Microwave Ovens comprise, with reference to FIG. 1, an oven cavity 1, a turntable 2, a magnetron 3, a wave guide 4, a strut 5, two supporting rollers 6, and a driving roller 7. The turntable 2 is provided for carrying a food. The wave guide 4 functions to transfer microwave energy from the magnetron 3 into the oven cavity 1 while microwave heating operations are being carried out in the conventional microwave oven. The turntable 2 is positioned on the strut 5, two supporting rollers 6, and the driving roller 7. The strut 5 and two supporting rollers 6 are provided for only supporting the turntable 2 at the positions thereof while the driving roller 7 serves to rotate and support the turntable 2.

A bottom wall 1*a* of the oven cavity has a configuration, as best shown in FIG. 2, where a circular recess 1*a*—*a* lower than the plane of the bottom wall 1*a* is provided. The left half of FIG. 2 depicts a cross-sectional view of the bottom wall 1*a* while the right half illustrates a plane view of the same. The strut 5, the supporting rollers 6, and the driving roller 7 are all arranged within the area of the lower circular recess 1*a*—*a*, whereby the upper surface of the turntable 2 is at the same level as the plane of the remaining portion of the bottom wall 1*a* except for the circular recess 1*a*—*a*.

This configuration is to minimize a space reguirement within the oven cavity 1 irrespective of the presence of the turntable 2. However, because of the uniformity of the surface of the circular recess 1*a*—*a*, the distance between the bottom wall 1*a* and the food positioned on the turntable 2 is unvaried while the turntable 2 is driven for cooking purposes. The food is thus overheated in one region and underheated in other regions. Therefore, uniform heating operations can not be expected for the food positioned on the turntable 2.

OBJECTS AND SUMMARY OF THE INVENTION

With the foregoing in mind, it is the primary object of the present invention to provide an improved microwave oven for performing uniform cooking operations for food arranged within the microwave oven.

It is another object of the present invention to provide an improved microwave oven which is resistant to water or the like in an oven cavity.

It is still another object of the present invention to provide an improved microwave oven comprising a turntable and a plurality of rollers related thereto, the rollers being compact and resistant to microwave energy.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, the bottom wall of an oven cavity of a microwave oven is provided with an uneven configuration so as to make the distance between a food carried on the table means and the bottom wall dependent on the position of the bottom wall. The electric field intensity of microwave energy reflected from the bottom wall is modified according to changing distances.

The table means can be a rotatable turntable and a fixed table. Therefore, the food carried on the table means undergoes a uniform application of the microwave energy.

If the turntable is provided within the microwave oven, in the specific form of the present invention, a plurality of rollers are required to support and drive the turntable. The rollers are arranged in such a manner as to be provided at a rising portion of the bottom wall. When water or the like is spilled into the oven cavity of the microwave oven, the rising portion prevents the rollers from getting wet by water or the like. Also, no water or the like intrudes into an electric circuit from the area where the rollers are arranged.

The rollers are positioned in such a manner that the majority portion of the rollers is behind the bottom wall, whereby they are prevented from being unnecessarily exposed to microwave energy.

Conventionally, the rollers are made of synthetic resin. The rollers are prevented from being deformed or dissolved by the microwave energy even if the microwave energy is generated in the absence of the food in the oven cavity of the microwave oven.

BRIEF DESCRIPTION OF THE DRAWINGS

The present invention will become more fully understood from the detailed description given hereinbelow and accompanying drawings which are given by way of illustration only, and thus are not limitative of the present invention and wherein.

DESCRIPTION OF THE PREFERRED EMBODIMENTS

The present invention is applicable to a microwave oven whether a rotatable turntable is provided. However, for convenience, the microwave oven with the turntable is described herein with reference to the drawings. The turntable may be substituted by a fixed table.

Figure 3:
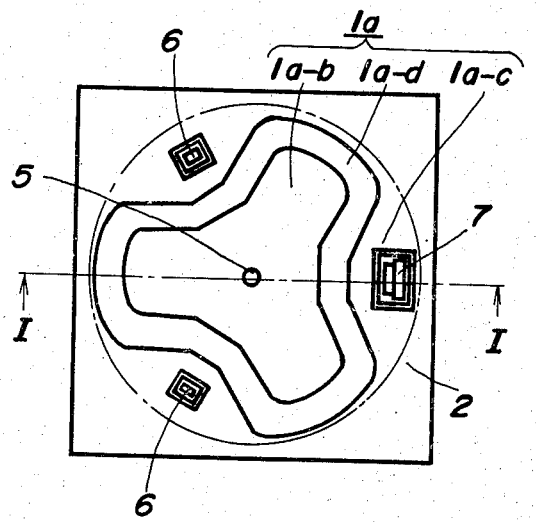
FIG. 3 is a plane view of a bottom wall of the present invention.
Figure 4:
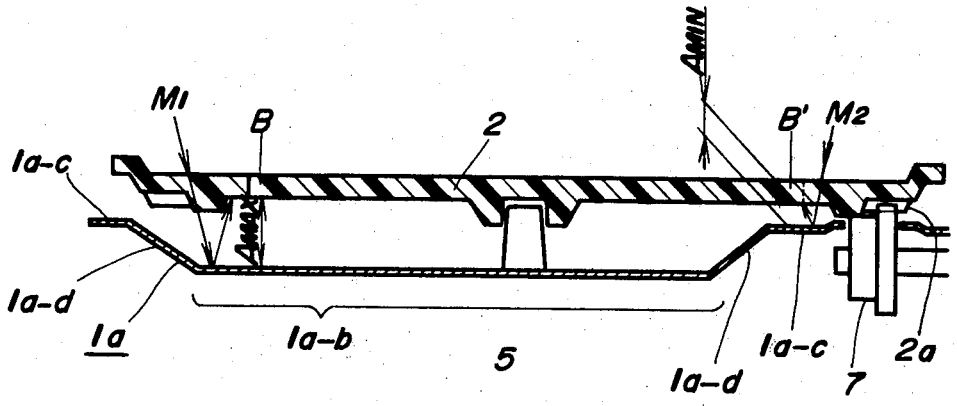
FIG. 4 is a cross-sectional view taken on line I—I in FIG. 3.

FIG. 3 shows a bottom wall of an oven cavity of the present invention of the microwave oven with the turntable. FIG. 4 illustrates the same in a cross-sectional view taken on line I—I in FIG. 3.

Figure 1:
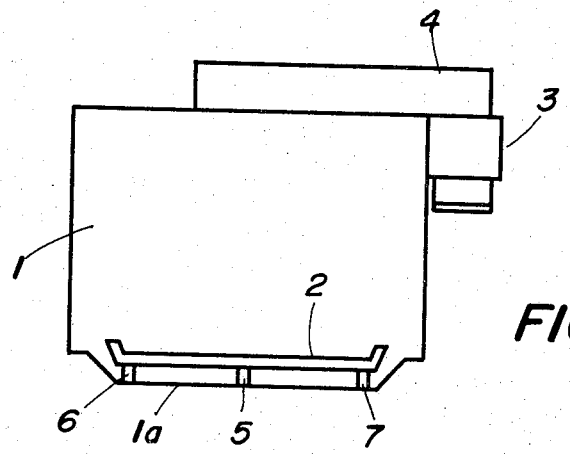
FIG. 1 PRIOR ART
FIG. 1 is a side view of a conventional microwave oven.
Figure 2:
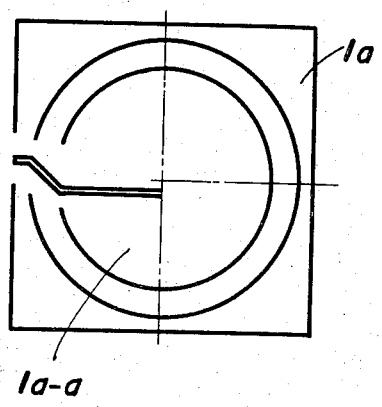
FIG. 2 PRIOR ART
FIG. 2 is a configuration of a bottom wall of an oven cavity of the microwave oven shown in FIG. 1, the left half being a cross-sectional view of the bottom wall and the right being a plane view of the same.

Like elements corresponding to those illustrated in FIGS. 1 and 2 are indicated by like numerals. In FIG. 3 the turntable 2 is represented by a chain line circle.

The bottom wall 1*a* includes a trefoil recess 1*a–b*, a declining portion 1*a–d*, and a rising portion 1*a–c*. The supporting rollers 6 and the driving roller 7 are arranged at the rising portion 1*a–c*.

The driving roller 7 has a gear at the pheripery thereof which is engaged with a grooved cam 2*a* which is formed along a circle of the turntable 2. The turntable 2 supported on the supporting rollers 6 and the driving roller 7 are rotated in unison with the rotation of the driving roller 7 by engagement of the gear of the roller 7 with the grooved cam 2*a* of the turntable 2. The driving roller 7 is activated by a motor (not shown).

With reference to FIG. 4, a predetermined area B of the turntable 2 travels on the trefoil recess 1*a–b* and the rising portion 1*a–c* as the turntable 2 is driven. This means that a distance A between the area B and the bottom wall 1*a* are varied in accordance with the rotation of the turntable 2. The distance A is $A_{MAX}$ of the largest value while the area B is positioned on the trefoil recess 1*a–b*. The distance A is $A_{MIN}$ of the smallest value while the area B' referred to the area B is passing on the rising portion 1*a–c*. Similarly, the distance A is a value between $A_{MAX}$ and $A_{MIN}$ while the area B is traveling on the declined portion 1*a–d*.

Electric field intensity of the microwave energy reflected from the bottom wall 1*a* is modified according to the variations in the distance A. The microwave energy depicted by M1 which is reflected from the trefoil recees 1*a–b* travels along the distance $A_{MAX}$. On the other hand, the microwave energy referred to M2 which is reflected from the rising potion 1*a–c* passes through the distance $A_{MIN}$. Therefore, the food carried on the turntable 2 undergoes uniform microwave application.

Even if the food is positioned at the center of the turntable 2, the food receives different intensities of an electric field of the microwave energy reflected from the different depths of the bottom wall 1*a* to have a uniform microwave application. That is, the food undergoes the uniform microwave application irrespective of its location on the turntable 2.

Although the lowest portion of the bottom wall 1*a* has a trefoil configuration, any to desired patterns can be used for the lowest portion inasmuch as the distance between the bottom wall 1*a* and the food carried on the turntable 2 is varied in the direction of the rotation on the turntable 2.

That is because the food passes above the uneven bottom wall 1*a* while the turntable 2 is rotated.

The variation in the distance between the bottom wall 1*a* and the food results in variations in the electric field intensity by the microwave energy propagation. More particularly, the variation of the electric field intensity by the microwave energy is derived from the difference between the distances $A_{MAX}$ and $A_{MIN}$. It is preferred that the difference be approximately $\lambda/4$ where $\lambda$ is the wavelength of the microwave energy. For the microwave frequency of 2.450 Hz, $\lambda$ is approximately equal to 4.8 inches (122.4 mm), and $\lambda/4$ then equals to 1.2 inches e.g. 30.6 mm. In a specific form of the present invention in practice, the difference is approximately 1 cm. When the difference is 15.0 mm, the strength of the microwave energy is approximately 70.7%.

Since the supporting rollers 6 and the driving roller 7 are all arranged at the rising portion 1*a–c*, the rising portion prevents the rollers 6 and 7 from being wet by in water of the like which is spilled within the microwave oven. No water or the like is drawn into the electric circuit portion from the area where the rollers 6 and 7 are disposed.

It is further desirable that the major majority portion of the rollers 6 and 7 are positioned behind wall 1*a*, especially, the rising portion 1*a–c*, whereby they are prevented from being unnecessarily exposed to the microwave energy. In case the rollers 6 and 7 are made of synthetic resin, for example, plastic, they are prevented from being damaged or dissolved by the microwave energy while the microwave energy is generated in the absence of the food in the oven cavity.

Compact rollers are available for the rollers 6 and 7 because the distance $A_{MIN}$ is selected to be small.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A microwave oven comprising:

a source of microwave energy for heating food;

a table means for carrying the food; and an oven cavity having a bottom wall with an uneven surface for providing random reflection of the microwave energy, wherein the distance between the uneven surface of the bottom wall of the oven cavity and the table means is variable because of said uneven surface, thereby unifying the intensity of the microwave energy throughout the oven cavity so that the food positioned on the table means is exposed to uniform intensity of the microwave energy.

2. The microwave oven according to claim 1, wherein the table means is a turntable.

3. The microwave oven according to claim 2, wherein the depth of the uneven surface of the bottom wall is varied with respect to the direction of rotation of the turntable.

4. The microwave oven according to claim 2, wherein the uneven surface of the bottom wall comprises a lower portion and a rising portion; and a roller is provided for supporting the turntable, said roller being positioned at the rising portion.

5. The microwave oven according to claim 2, wherein a roller is further provided for supporting the turntable; and the majority portion of the roller is arranged behind the uneven surface of the bottom wall so as to prevent the roller from being damaged by the application of the microwave energy while the microwave energy is generated in the absence of the food in the microwave oven.

6. The microwave oven according to claim 2, wherein the uneven surface of the bottom wall comprises a lower portion and a rising portion; and a driving roller is further provided for driving the turntable, said driving roller being arranged at the rising portion.

7. The microwave oven according to claim 2, wherein a driving roller is further provided for driving the turntable; and the major portion of the driving roller is arranged behind the uneven surface of the bottom wall so as to prevent the driving roller from being damaged by the application of the microwave energy while the microwave energy is generated in the absence of the food in the microwave oven.

8. The microwave oven according to claims 5 or 7, wherein the roller and the driving roller are made of a synthetic resin.

9. The microwave oven according to claim 6, wherein the turntable has a grooved cam at the periphery thereof; and the driving roller is engaged with said grooved cam of the turntable for driving purposes.

10. The microwave oven according to claim 1, wherein the table means is a plate.

11. A microwave oven according to claims 2 or 10, wherein the uneven surface of the bottom wall comprises a lower portion and a rising portion; and the distance between both the lower portion and the rising portion and either the turntable or the plate means is defined within about 30.6 mm.

12. The microwave oven according to claim 1, wherein the table means is a fixed table.

* * * * *